US009514901B2

(12) United States Patent
Taniguchi et al.

(10) Patent No.: US 9,514,901 B2
(45) Date of Patent: Dec. 6, 2016

(54) PUSH SWITCH USING A HEART SHAPED CAM

(71) Applicant: OMRON Corporation, Kyoto-shi, Kyoto (JP)

(72) Inventors: Akio Taniguchi, Tottori (JP); Yasuhiro Kiyono, Kyoto (JP)

(73) Assignee: OMRON Corporation, Kyoto (JP)

( * ) Notice: Subject to any disclaimer, the term of this patent is extended or adjusted under 35 U.S.C. 154(b) by 11 days.

(21) Appl. No.: 14/403,592

(22) PCT Filed: Jun. 25, 2013

(86) PCT No.: PCT/JP2013/067314

§ 371 (c)(1),
(2) Date: Nov. 25, 2014

(87) PCT Pub. No.: WO2014/002976

PCT Pub. Date: Jan. 3, 2014

(65) Prior Publication Data

US 2015/0107980 A1 Apr. 23, 2015

(30) Foreign Application Priority Data

Jun. 29, 2012 (JP) ..... 2012-147859

(51) Int. Cl.
*H01H 3/42* (2006.01)
*H01H 13/56* (2006.01)
(Continued)

(52) U.S. Cl.
CPC ..... *H01H 13/562* (2013.01); *H01H 3/42* (2013.01); *H01H 5/14* (2013.01); *H01H 13/26* (2013.01); *H01H 13/30* (2013.01)

(58) Field of Classification Search
CPC ..... H01H 13/562
USPC ..... 200/524, 416, 417
See application file for complete search history.

(56) References Cited

U.S. PATENT DOCUMENTS 4,531,026 A 7/1985 Terajima et al.
4,956,529 A 9/1990 Ueno
8,134,095 B2 * 3/2012 Kiyono ..... H01H 5/14 200/417

FOREIGN PATENT DOCUMENTS

EP 0721196 A1 7/1996
EP 2012333 A1 1/2009
(Continued)

OTHER PUBLICATIONS

International Preliminary Report on Patentability mailed Jan. 8, 2015 in related International Application No. PCT/JP2013/067314 (8 pages).
(Continued)

*Primary Examiner* — Vanessa Girardi
(74) *Attorney, Agent, or Firm* — Osha Liang LLP

(57) ABSTRACT

A heart cam mechanism of a switch includes a cam groove, which includes a heart cam and surrounding cams, and a lock pin. The heart cam has a concave part, a first vertex opposite the concave part, and second and third vertices on a concave-part side. While the switch is in a locked state, an upper end part of the lock pin is engaged with the concave part of the heart cam, and is positioned at a locking position. While the switch is pressed, the upper end part slides while pushing against a bottom surface of the cam groove located outside the heart cam, and moves along a heart-shaped path, which is depressed at the locking position. This configuration prevents an end part of the lock pin from moving in a reverse direction even when a step-like part of the bottom surface of the cam groove is worn out.

4 Claims, 11 Drawing Sheets

(51) Int. Cl.

| | |
|---|---|
| ***H01H 5/14*** | (2006.01) |
| ***H01H 13/26*** | (2006.01) |
| *H01H 13/30* | (2006.01) |

(56) References Cited

FOREIGN PATENT DOCUMENTS

| | | |
|---|---|---|
| GB | 2 051 481 A | 1/1981 |
| JP | 50-42283 | 4/1975 |
| JP | 53-5771 | 1/1978 |
| JP | 55-15741 | 1/1980 |
| JP | 56-6328 A | 1/1981 |
| JP | S5611702 Y2 | 3/1981 |
| JP | 8-227627 A | 9/1996 |
| JP | 11-67006 A | 3/1999 |

OTHER PUBLICATIONS

International Search Report for corresponding International Application No. PCT/JP2013/067314, mailed Sep. 17, 2013 (2 pages).
Written Opinion for corresponding International Application No. PCT/JP2013/067314, mailed Sep. 17, 2013 (4 pages).
Extended European Search Report in counterpart European Patent Application No. 13809472.7, dated Mar. 9, 2016 (7 pages).
Office Action in counterpart Chinese Patent Application No. 201380027850.4, dated Nov. 3, 2015 (13 pages).

* cited by examiner

PUSH SWITCH USING A HEART SHAPED CAM

TECHNICAL FIELD

The present invention relates to a heart cam mechanism and a switch including the heart cam mechanism.

BACKGROUND ART

A switch, which has a contact point that can be opened/closed by a pressing operation, includes a lock pin for maintaining a closed state of the switch. Conventionally, a cam-groove structure having a heart cam shape has been used as a cam-groove structure for sliding an end part of a lock pin.

A cam-groove structure having a heart cam shape is disclosed in, for example, Patent Literature 1. This type of cam-groove structure includes (i) a locking section for locking an end part of a lock pin and (ii) a cam groove surrounding an outer periphery of the locking section. While a closed state of a switch is maintained, the end part of the lock pin is locked by the locking section. An open/close mechanism of the switch is made possible by causing the cam groove to slide the end part of the lock pin in a fixed direction (not to slide the end part in a reverse direction).

FIG. 11 is a plan view illustrating the cam-groove structure disclosed in Patent Literature 1. According to the cam-groove structure illustrated in FIG. 11, respective depths of following three regions with respect to a lock pin in a cam groove 102 are set to be equal: (i) a free region 107, (ii) a locking region 108, and (iii) a particular flat path region in a guiding return path extending from the locking region 108 to the free region 107. According to the cam-groove structure of Patent Literature 1, an end part of the lock pin is prevented from moving in a reverse direction by (i) causing the end part of the lock pin to be in contact with a bottom surface of a cam groove by use of a pressing spring member and (ii) configuring the bottom surface of the cam groove to have a step-like form.

CITATION LIST

Patent Literature

Patent Literature 1

Japanese Patent Application Publication, Tokukaihei, No. 8-227627 (Publication Date: Sep. 3, 1996

SUMMARY OF INVENTION

However, according to the cam-groove structure of Patent Literature 1, repeated operations to press the switch cause the step-like part on the bottom surface to be worn out and/or cause a reduction in force to press the lock pin. Therefore, the upper end part of the lock pin may slide in an unintended direction and therefore hinder an open/close mechanism of the switch.

Therefore, one or more embodiments of the claimed invention provides a heart cam mechanism and a switch including the heart cam mechanism, which realize a highly reliable switch open/close mechanism by preventing an end part of a lock pin from moving in a reverse direction even in a case where a step-like part of a bottom surface of a cam groove is worn out.

According to one or more embodiments of the claimed invention, a heart cam mechanism includes: a cam groove including a heart cam and surrounding cams; and a lock pin (i) having one end part which is fixed and (ii) the other end part which is a sliding end part that slides while pushing against a bottom surface of the cam groove, the heart cam having a concave part for engaging with the sliding end part and releasing the engaging so as to switch between a locked state and an unlocked state of a switch whose contact point is opened or closed by a pressing operation, the sliding end part being configured to engage with the concave part at a locking position, the sliding end part being configured to simultaneously (i) make reciprocating motion in a pressing-operation direction in which the pressing operation is carried out and (ii) move, in the cam groove located outside the heart cam, along a heart-shaped path which is depressed at the locking position, the heart-shaped path having a first position which is a vertex position opposite the locking position and having a second position and a third position which are two vertex positions on a locking-position side, the sliding end part being configured to pass through the first position, the second position, the locking position, and the third position in this order, the heart cam having a first vertex, a second vertex, and a third vertex corresponding to the first position, the second position, and the third position of the heart-shaped path, respectively, a surrounding cam, which faces the concave part, having a locking position guiding point for guiding the sliding end part from the second position to the locking position, and the heart cam and the surrounding cams being provided such that, while the sliding part is located at each one of the first position, the second position, the locking position, and the third position, a center part of the sliding end part is shifted from a corresponding one of reference lines toward part of the heart-shaped path where the sliding end part will move from said each one of the positions to a next position, the reference lines being respective lines extending in the pressing-operation direction from the first vertex, the second vertex, the locking position guiding point, and the third vertex.

Advantageous Effects of Invention

The heart cam mechanism according to one or more embodiments of the claimed invention is configured such that the sliding end part being configured to engage with the concave part at a locking position, during a pressing operation, the sliding end part being configured to move, in the cam groove located outside the heart cam, along a heart-shaped path which is depressed at the locking position, the heart-shaped path having a first position which is a vertex position opposite the locking position and having a second position and a third position which are two vertex positions on a locking-position side, the sliding end part being configured to pass through the first position, the second position, the locking position, and the third position in this order, the heart cam having a first vertex, a second vertex, and a third vertex corresponding to the first position, the second position, and the third position of the heart-shaped path, respectively, a surrounding cam, which faces the concave part, having a locking position guiding point for guiding the sliding end part from the second position to the locking position, and the heart cam and the surrounding cams being provided such that, while the sliding part is located at each one of the first position, the second position, the locking position, and the third position, a center part of the sliding end part is shifted from a corresponding one of reference lines toward part of the heart-shaped path where the sliding end part will move from said each one of the positions to a next position, the reference lines being respective lines extending in the pressing-operation direction from the first vertex, the second vertex, the locking position guiding point, and the third vertex.

A switch according to one or more embodiments of the claimed invention includes: a pressing part by which a pressing operation is carried out to open or close a circuit; the above-described heart cam mechanism; and a base that fixes the one end part of the lock pin.

Therefore, it is possible to bring about an effect of realizing a highly reliable switch open/close mechanism that prevents an end part of a lock pin from moving in a reverse direction even in a case where a step-like part of a bottom surface of a cam groove is worn out.

DESCRIPTION OF EMBODIMENTS

Figure 1:
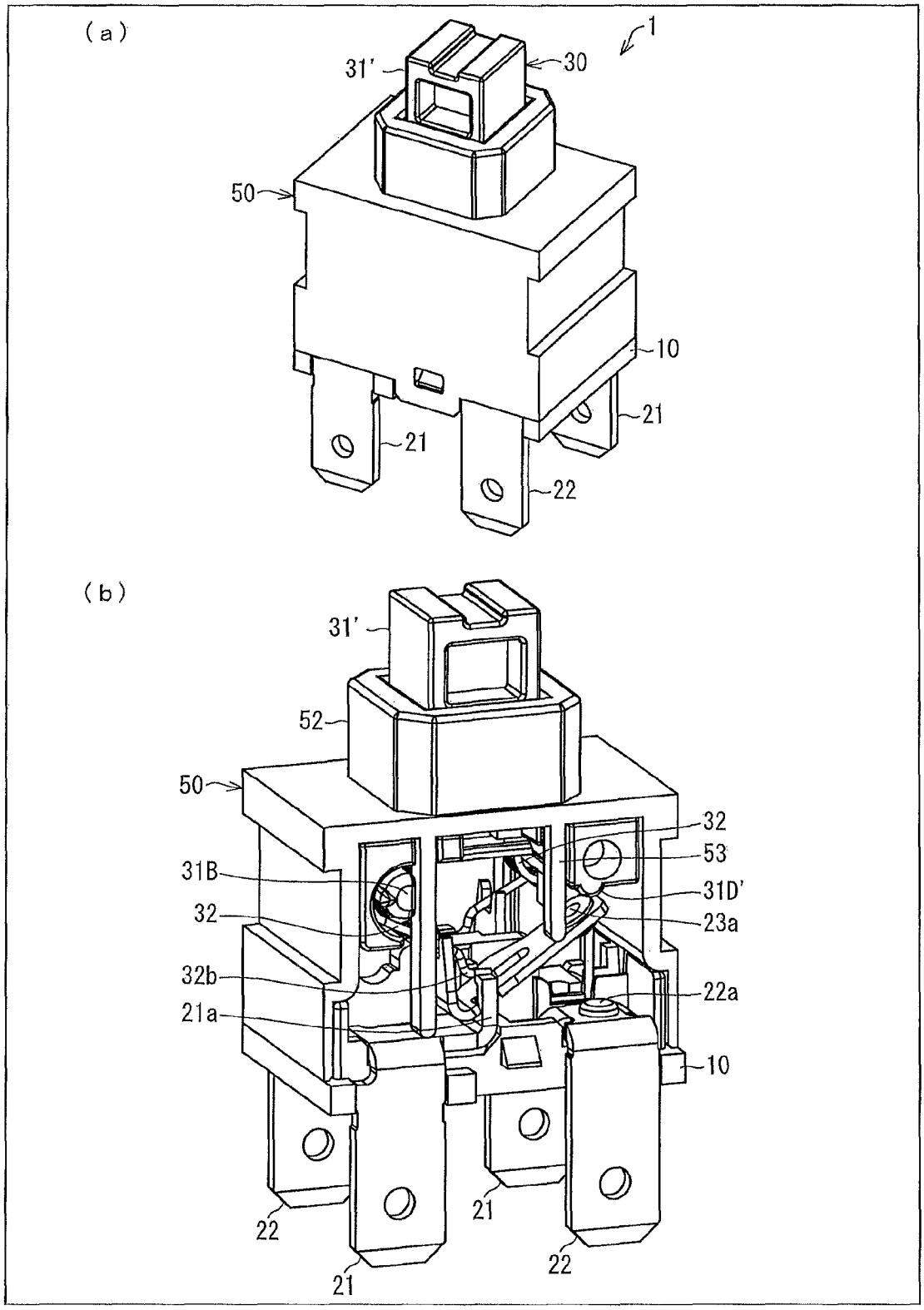
FIG. 1 is a set of views (a) and (b) illustrating a prerequisite switch configuration for an embodiment of the claimed invention; (a) of FIG. 1 being a perspective view illustrating an external appearance and (b) of FIG. 1 being a perspective view illustrating an internal configuration.

First, a prerequisite configuration for a switch in accordance with an embodiment of the claimed invention will be described in detail with reference to (a) and (b) of FIG. 1 through (a) through (e) of FIG. 8.

(1) Configuration of Switch

Figure 2:
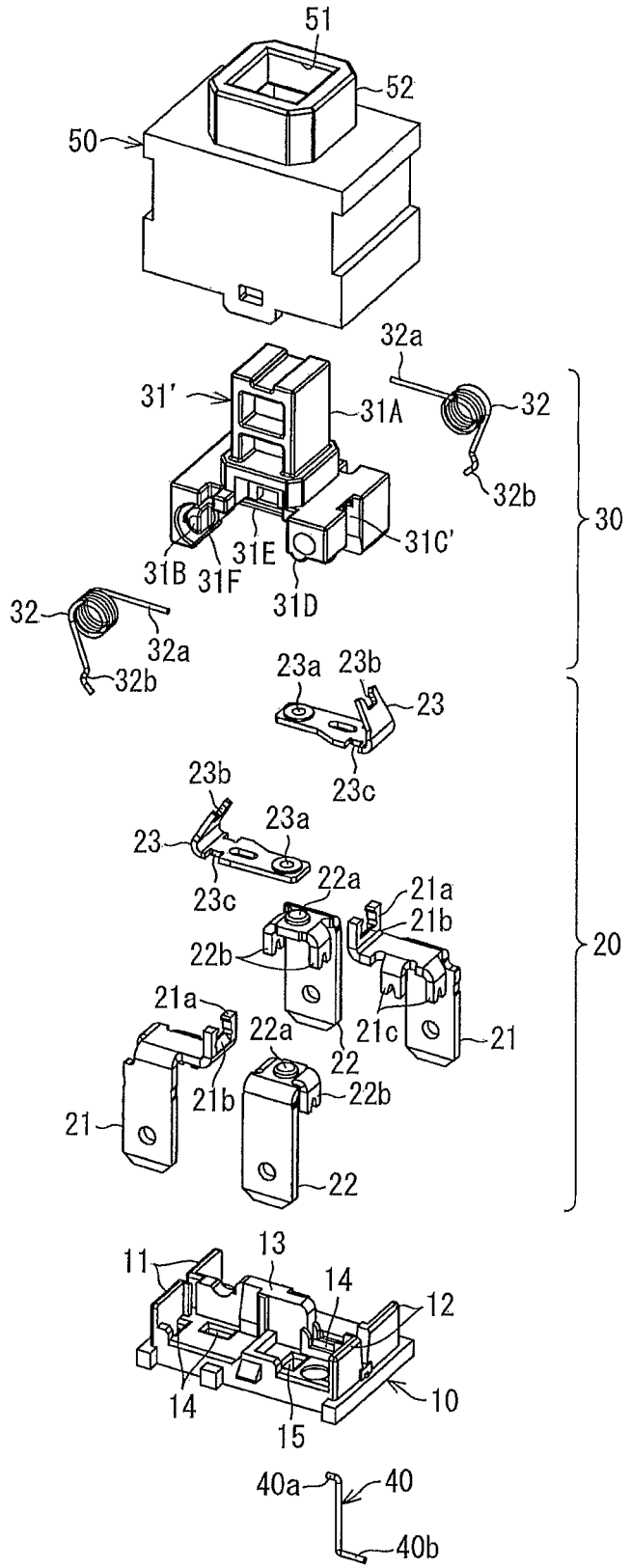
FIG. 2 is an exploded perspective view of the switch illustrated in FIG. 1.
Figure 3:
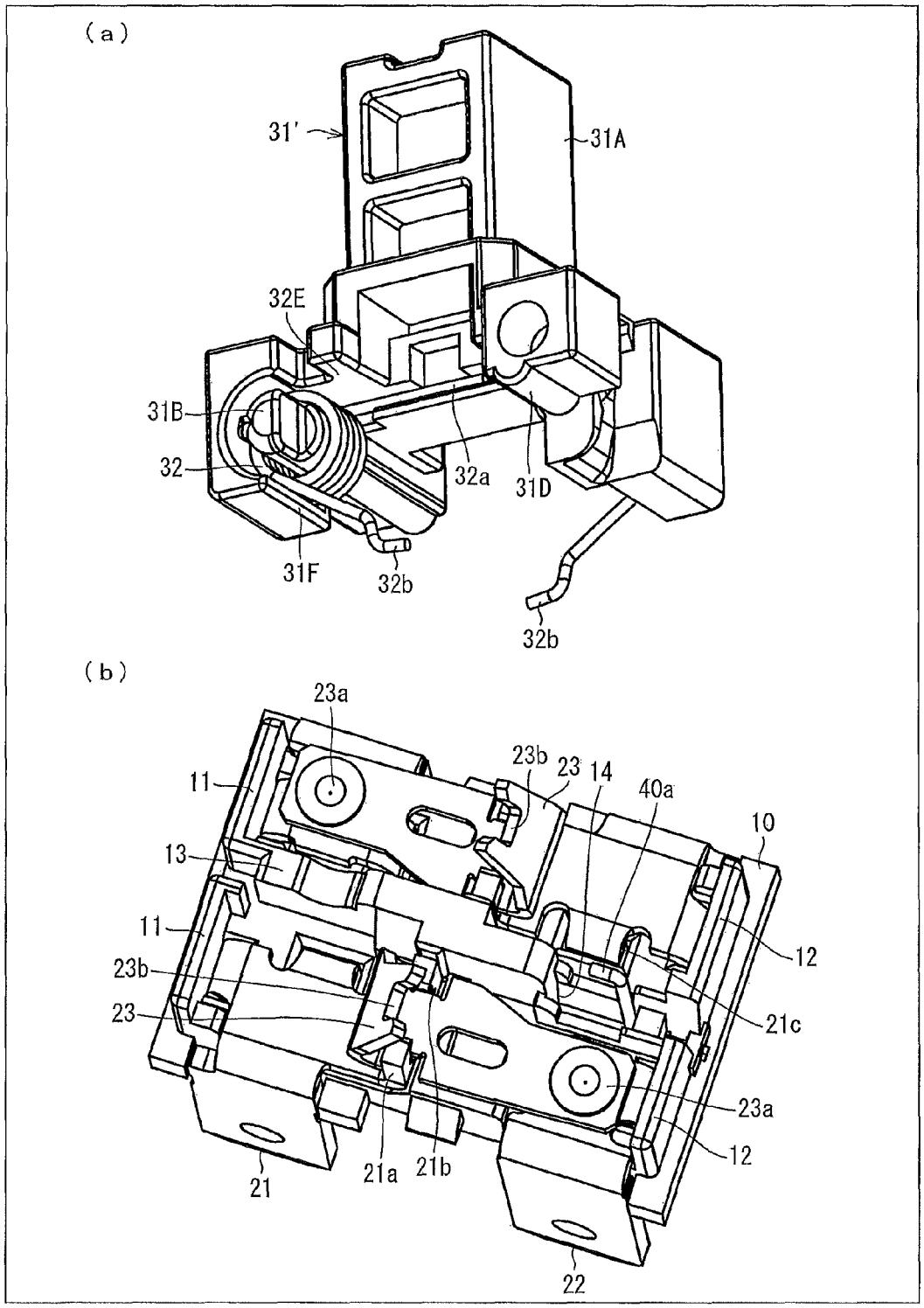
FIG. 3 is a set of views (a) and (b) illustrating a configuration of a base with which a plunger section and a contact point mechanism included in the switch of FIG. 1 are combined; (a) of FIG. 3 being a perspective view illustrating a configuration of the plunger section and (b) of FIG. 3 being a perspective view illustrating a configuration of the base with which the contact point mechanism is combined.

First, a configuration, which is a prerequisite of the switch of the present embodiment (hereinafter referred to as "present switch"), will be described. FIG. 1 is a set of views (a) and (b), illustrating a configuration which is a prerequisite for the present switch (switch equipped with a reset function). (a) of FIG. 1 is a perspective view illustrating an external appearance, and (b) of FIG. 1 is a perspective view illustrating an internal configuration. FIG. 2 is an exploded perspective view of the switch. FIG. 3 is a set of views (a) and (b), illustrating a configuration of a base 10 with which a plunger section 30' and a contact point mechanism 20 are combined. (a) of FIG. 3 is a perspective view illustrating a configuration of the plunger section 30', and (b) of FIG. 3 is a perspective view illustrating the configuration of the base 10 with which the contact point mechanisms 20 are combined.

The present switch is that of a push type, and has such a prerequisite configuration as including (i) the base 10 which is rectangular-shaped, (ii) two pairs of contact point mechanisms 20 combined with the base 10, (iii) the plunger section 30', (iv) a lock pin 40, and (v) a housing 50. The housing 50 is to be coupled with the base 10 so as to cover the contact point mechanisms 20 as well as supports the plunger section 30 such that the plunger section 30' can move vertically.

As illustrated in FIG. 2, one side part of the rectangular shape of the base 10 is provided with a pair of walls 11•11. The other side part is provided with a pair of walls 12•12 such that the pair of walls 12•12 face the walls 11•11. The base 10 also includes a dividing wall 13 which stands on a center part of a top surface of the base 10. The dividing wall 13 extends in a direction from the walls 11 to the walls 12. In the vicinity of an end part on a walls-side-12 side of the dividing wall 13, an engaging groove 14 is provided.

As illustrated in FIG. 2, the contact point mechanism 20 includes (i) supporting terminals 21, (ii) fixing contact point terminals 22, and (iii) movable contact segments 23. The supporting terminals 21 are each configured by an electrically conductive material which is bent so as to have an L-shaped cross section. One end part of each of the supporting terminals 21 is provided with a rising piece 21*a* that rises upwards. A rotation bearing part 21*b* is provided so as to notch an edge part of the rising piece 21*a*. The supporting terminals 21 are combined with the base 10 such that press-fitting tongues 21*c* protruding downwards from the respective supporting terminals 21 are press-fitted into corresponding press-fitting openings 15 of the base 10.

The fixing contact point terminals 22 are each bent so as to have a substantially L-shaped cross-section. A fixing contact point 22*a* is provided at one end part of each of the fixing contact point terminals 22. The fixing contact point terminals 22 are combined with the base 10 such that press-fitting tongues 22*b* protruding downwards from the respective fixing contact point terminals 22 are press-fitted into corresponding press-fitting openings 15 of the base 10.

The movable contact segments 23 are each configured by an electrically conductive material which is bent so as to have a substantially J-shaped cross section. One end part of each of the movable contact segments 23 is provided with a movable contact point 23*a*. An apical surface of the other end part, a sliding notched groove 23*b* is provided. The movable contact segments 23 are rotatably supported by causing respective narrow parts 23*c*, each of which is formed by notching both lateral end parts of the movable contact segment 23, to engage with corresponding rotation bearing part 21*b* of the respective supporting terminals 21.

The plunger section 30' includes a plunger main body (pressing part) 31' and coil springs 32•32. The plunger main body 31' has a form that can be accommodated between the walls 11 and the walls 12 which face each other on the base 10. An operation part 31A, which is intended for pressing operation, is provided so as to protrude from a center part of a top surface of the form. At a front surface and a back surface of the plunger main body 31', respective shank parts 31B are provided so as to have point symmetry therebetween. Coil springs 32•32 are inserted into sides of the plunger main body 31' and supported by the shank parts 31B. The plunger main body 31' also includes, on a lateral surface thereof, a cam groove 31C'. The cam groove 31C' is included to lock the plunger main body 31' at a predetermined position via the lock pin 40. The plunger main body 31' also includes, on a bottom surface thereof, pressing convex parts 31D which protrudes parallel to the shank parts 31B.

The coil springs 32 are each inserted into a corresponding one of the shank parts 31B while both end parts 32*a* and 32*b* of the coil spring 32 are inwardly flexed. This (i) causes the end parts 32*a* of the respective coil springs 32 to apply pressure against and to be in contact with corresponding ceiling surfaces 31E of the plunger main body 31 and (ii) causes the end parts 32*b* of the respective coil springs 32 to apply pressure against and to be in contact with corresponding edge parts 31F of the plunger main body 31.

The lock pin 40 has an upper end part 40*a* (sliding end part) and a lower end part 40*b* which are formed by bending both end parts of a rod-shaped metal material in reverse directions.

The housing 50 has a box-like form that can be coupled with an outer periphery of the base 10 with which the contact point mechanism 20, the plunger section 30', and the lock pin 40 are being combined. On a center part of a top surface of the box-like form, an annular rib 52 is provided, the annular rib 52 forming an operation opening 51 into which the operation part 31A of the plunger main body 31' is to be inserted. On an inner surface of the housing 50, position restricting convex parts 53, which restrict positions of the respective movable contact segments 23, are provided.

Figure 4:
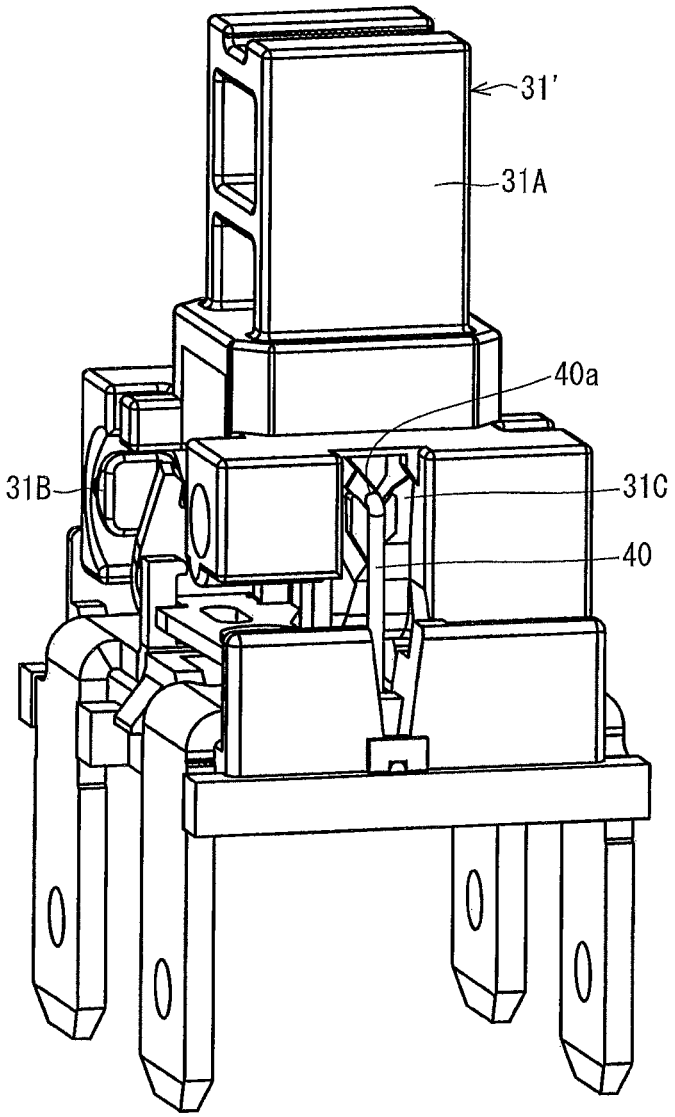
FIG. 4 is a perspective view illustrating a configuration in which a housing is removed from the switch illustrated in FIG. 1.

An example of how to assemble the switch is as follows: First, the lower end part 40*b* of the lock pin 40 is inserted from above into the engaging groove 14 of the base 10 with which the contact point mechanism 20 is coupled, and is then slid to a side so as to be prevented from coming off. Then, as illustrated in FIG. 4, the plunger main body 31' with which the coil springs 32 are coupled (i.e. the plunger section 30') is inserted from above in between the walls 11•12 of the base 10 and is then positioned. Then, the upper end part 40*a* of the lock pin 40 is engaged with the cam groove 31C' of the plunger main body 31'. This causes the operation part 31A of the plunger main body 31' to protrude out of the operation opening 51 of the housing 50. In addition, the end parts 32*b* of the coil springs 32 slidably engage with the corresponding sliding notched grooves 23*b* of the movable contact segments 23, so that the movable contact segments 23 is energized to be pulled upwards. This causes the movable contact points 23*a* of the movable contact segments 23 to be separated from the corresponding fixing contact points 22*a*.

(2) Method of Operating Switch

A method of operating the switch will be described next.

Figure 5:
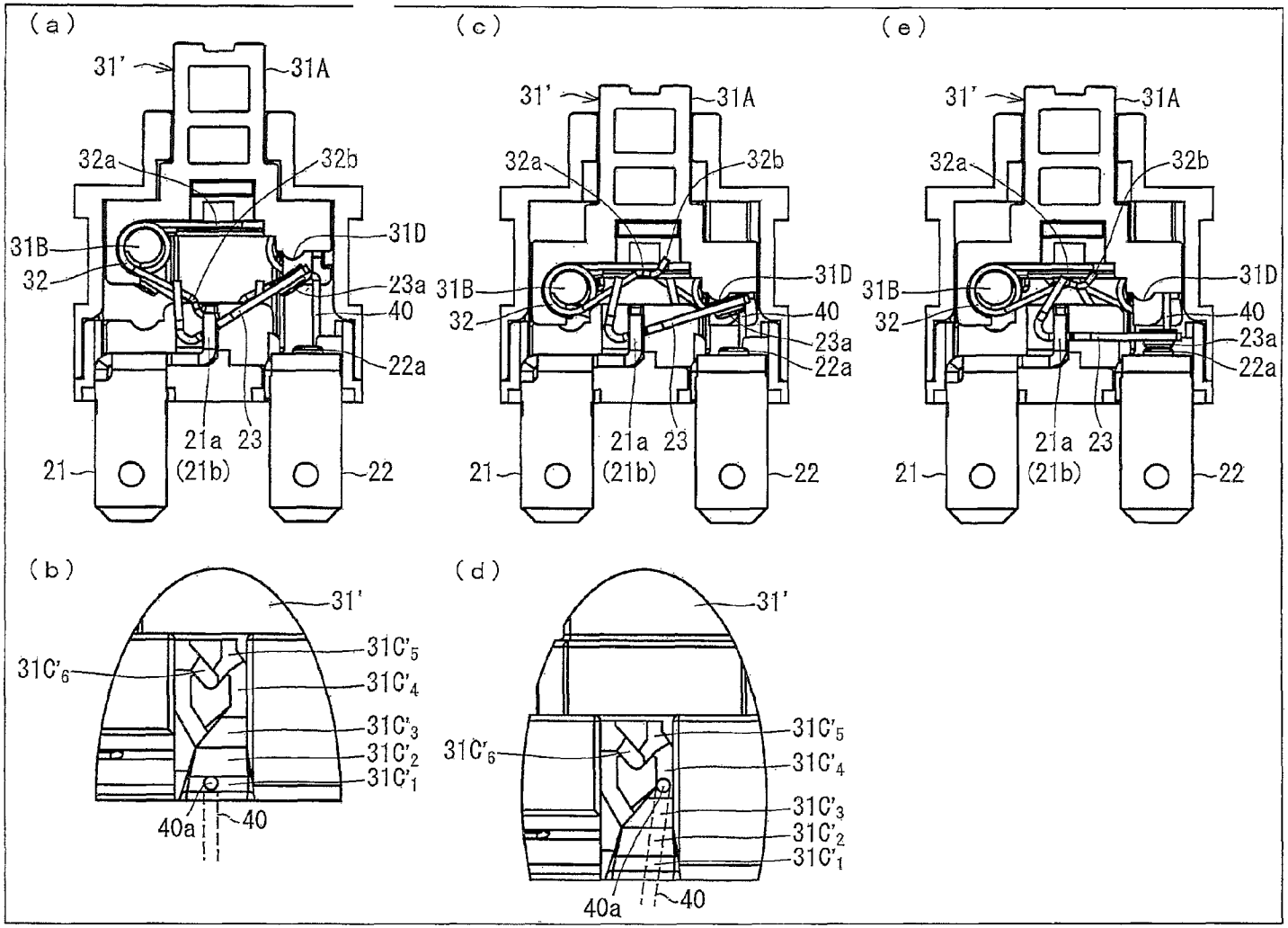
FIG. 5 is a set of cross-sectional views (a) through (e); (a), (c), and (e) of FIG. 5 being cross-sectional views illustrating a process of an operation on the switch illustrated in FIG. 1 and (b) and (d) of FIG. 5 being partially enlarged views illustrating motion of a heart cam mechanism.

As illustrated in (a) of FIG. 5, before the switch is operated, spring force of the coil springs 32 causes the end parts 32*a* to be energized upwards. This causes the plunger main body 31' to be pulled upwards. On the other hand, the spring force of the coil springs 32 causes force that pulls the end parts 32*b* of the coil springs 32 downwards. This causes the end parts 32*b* of the coil springs 32 to push down the other end parts of the movable contact segments 23 (i.e. ends parts opposites the respective movable contact points 23*a*). Note that, the position restricting convex parts 53 are provided on the inner surface of the housing 50 (see (b) of FIG. 1). This causes the one end parts of the movable contact segments 23 to come into contact with lower end parts of the position restricting convex parts 53, and therefore prevents the movable contact segments 23 from falling off. In so doing, as illustrated in (b) of FIG. 1, the upper end part 40*a* of the lock pin 40 falls in an initial region 31$C_1$' of the cam groove 31C' of the plunger main body 31'.

Then, when the operation part 31A of the plunger main body 31' is pushed down as illustrated in (c) of FIG. 5, (i) the coil springs 32 becomes bent and (ii) the end parts 32*b* of the coil springs 32 slide in the corresponding sliding notched grooves 23*b* of the movable contact segments 23 while energizing the movable contact segments 23 to be pulled upwards. Then, the pressing convex parts 31D of the plunger main body 31' push down the corresponding one end parts of the movable contact segments 23 (i.e. end parts on respective movable-contact-point-23*a* sides). In so doing, the upper end part 40*a* of the lock pin 40 presses against the bottom surface of the cam groove 31C' as well as slide so as to move from the initial region 31$C_1$' to a first inclined groove 31$C_2$' to a second inclined groove 31$C_3$' to a third inclined groove 31$C_4$' (see (d) of FIG. 5).

Furthermore, in a case where the end parts 32*a* of the coil springs 32 exceed their respective predetermined positions by pressing in of the operation part 31A of the plunger main body 31', the end parts 32*a* energize the corresponding movable contact segments 23 to be pushed over. This causes the movable contact segments 23 to instantly rotate with the corresponding rotation bearing parts 21*b* of the supporting terminals 21 serving as supporting points, and therefore causes the movable contact point 23*a* to come into contact with the corresponding fixing contact points 22*a* (see (e) of FIG. 5).

Figure 6:
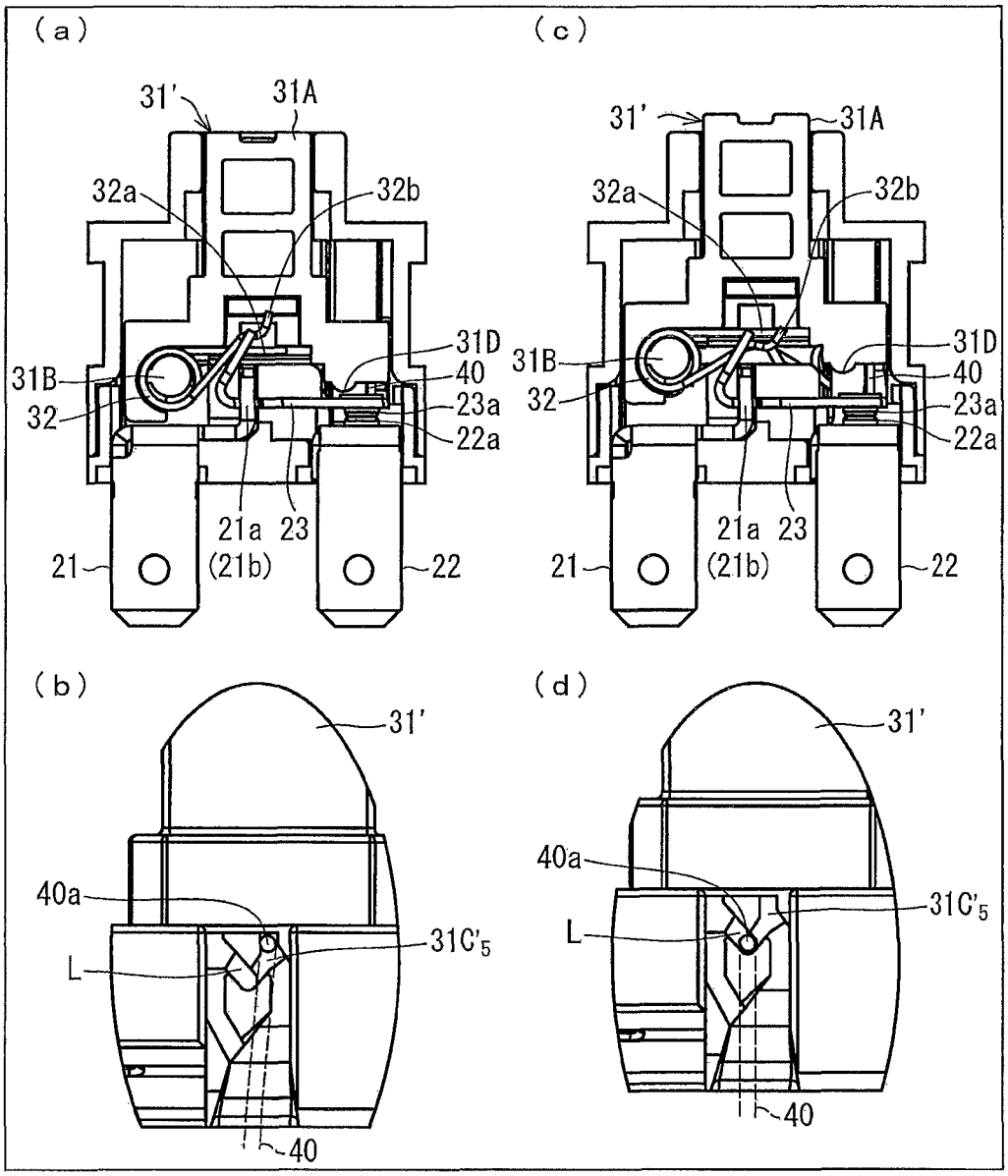
FIG. 6 is a set of views (a) through (d); (a) and (c) of FIG. 6 being cross-sectional views illustrating a process following the process of the operation illustrated in FIG. 5 and (b) and (d) of FIG. 6 being partially enlarged views illustrating motion following the motion of the heart cam mechanism illustrated in FIG. 5.

Next, as illustrated (a) of FIG. 6, when the operation part 31A of the plunger main body 31' is pressed in to a lowest level, the upper end part 40*a* of the lock pin 40 reaches a fourth inclined groove 31$C_5$' (see (b) of FIG. 6). Then, when the pressing of the plunger main body 31' is released, the spring force of the coil springs 32 pushes the plunger main body 31' upwards. In so doing, the upper end part 40*a* of the lock pin 40 becomes locked at a locking position L as illustrated in (d) of FIG. 6. This prevents the plunger main body 31' from returning upwards, and therefore causes the plunger main body 31' to be in a locked state. Therefore, as illustrated in (c) of FIG. 6, the end parts 32*b* of the coil springs 32 continuously energize the corresponding movable contact segments 23 to be pushed over, and therefore continuously cause the movable contact points 23*a* to be in contact with the corresponding fixing contact points 22*a*.

Figure 7:
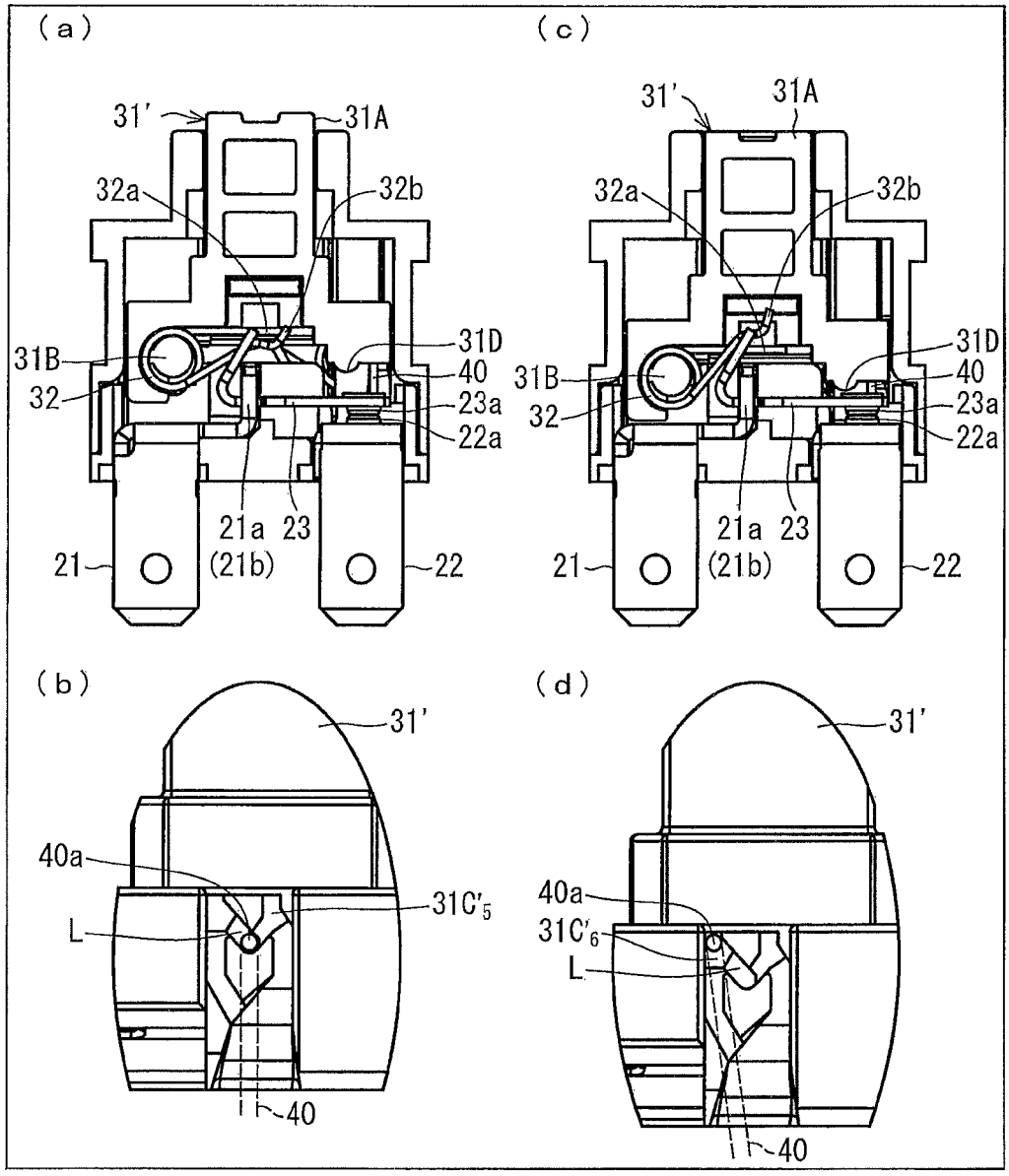
FIG. 7 is a set of views (a) through (d); (a) and (c) of FIG. 7 being cross-sectional views illustrating a process following the process of the operation illustrated in FIG. 6 and (b) and (d) of FIG. 7 being partially enlarged views illustrating motion following the motion of the heart cam mechanism illustrated in FIG. 6.

Next, in a case where the locked state (see (a) and (b) of FIG. 7) is to be released, the operation part 31A of the plunger main body 31' is to be pressed down one level deeper as illustrated in (c) of FIG. 7. This causes the upper end part 40*a* of the lock pin 40 to move from the locking position L to a fifth inclined groove 31$C_6$', and therefore causes the locked state to be released (see (d) of FIG. 7).

Figure 8:
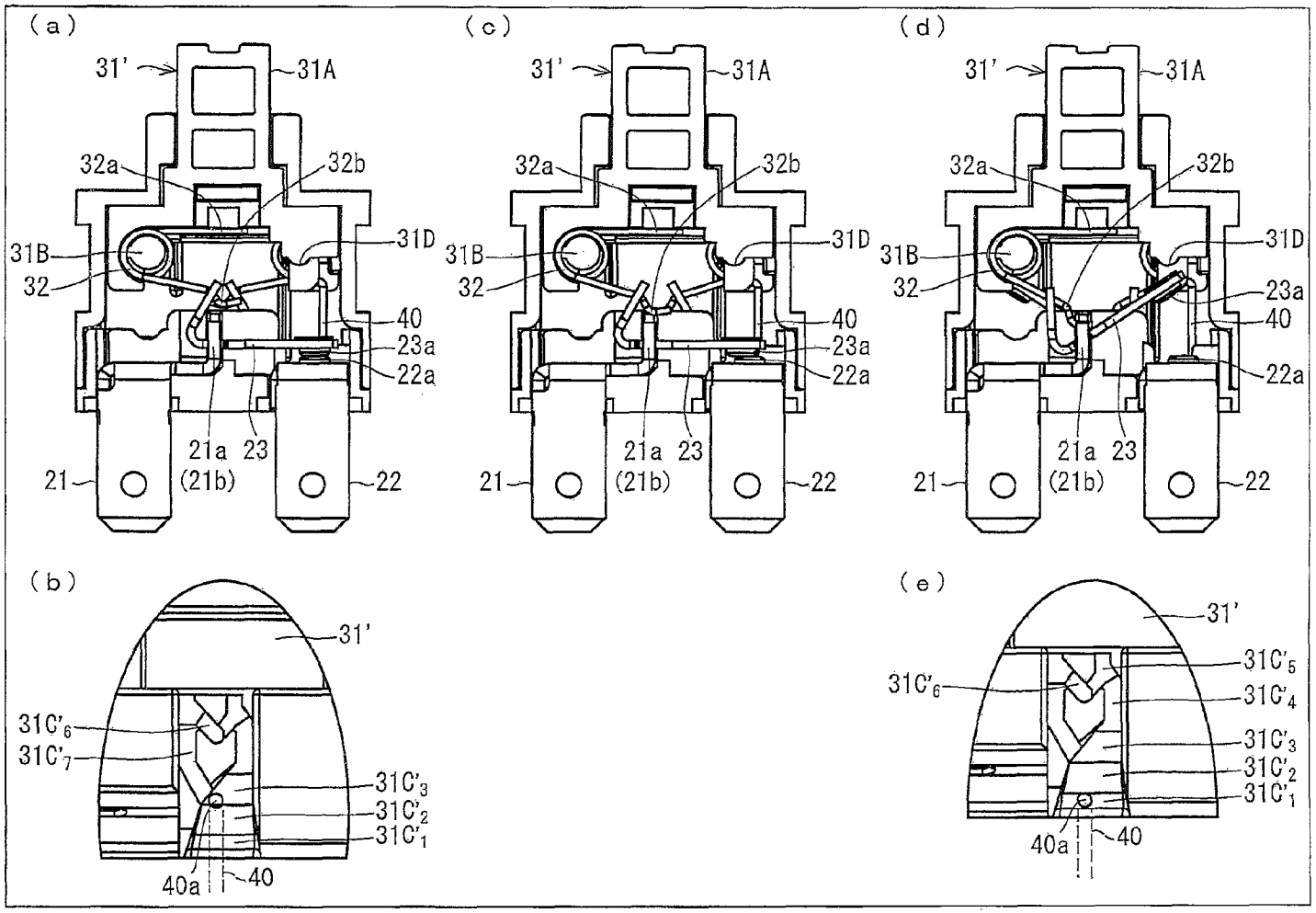
FIG. 8 is a set of views (a) through (e); (a), (c), and (d) of FIG. 8 being cross-sectional views illustrating a process following the process of the operation illustrated in FIG. 7 and (b) and (e) of FIG. 8 being partially enlarged views illustrating motion following the motion of the heart cam mechanism illustrated in FIG. 7.

Next, when the pressing of the operation part 31A is released, the coil springs 32 energize the corresponding movable contact segments 23 to be pushed over while pressing the plunger main body 31' upwards (see (a) of FIG. 8). In so doing, the upper end part 40*a* passes through the fifth inclined groove 31$C_6$' and then sixth inclined groove 31$C_7$', and then returns to the second inclined groove 31$C_3$' (see (b) of FIG. 8). Furthermore, when the plunger main body 31' automatically returns to an initial position, the end parts 32*b* of the coil springs 32 energize, from a predetermined position, corresponding the movable contact segments 23 to be pulled up. Then, the movable contact segments 23 instantly rotate with the corresponding rotation bearing parts 21*b* serving as supporting points, so that the movable contact points 23*a* become separated from the corresponding fixing contact points 22*a* (see (c) of FIG. 8). Furthermore, when the movable contact segments 23 thus rotate, the one end parts of the movable contact segments 23 (end parts on the respective movable-contact-point-23 sides) (i) come into contact with the corresponding pressing convex parts 31D of the plunger main body 31', (ii) come into contact with the corresponding position restricting convex parts 53 provided on the inner surface of the housing 50, and then (iii) become positionally restricted (see (d) of FIG. 8). Then, the upper end part 40*a* of the lock pin 40 returns to the initial region 31$C_1$' of the cam groove 31C' (see (e) of FIG. 8).

(3) Special Feature of Present Switch: Structure of Cam Groove of Plunger Main Body 31 (Heart Cam Mechanism)

Note that according to a structure of the cam groove 31C' of the plunger main body 31' described above, repeated operations to press the switch cause an inclined part of the cam groove 31C' to be worn out and/or cause a reduction in force to press the lock pin 40. Therefore, in the switch illustrated in FIG. 1, the upper end part 40*a* of the lock pin 40 may slide in an unintended direction and therefore hinder an open/close mechanism of the switch.

Figure 9:
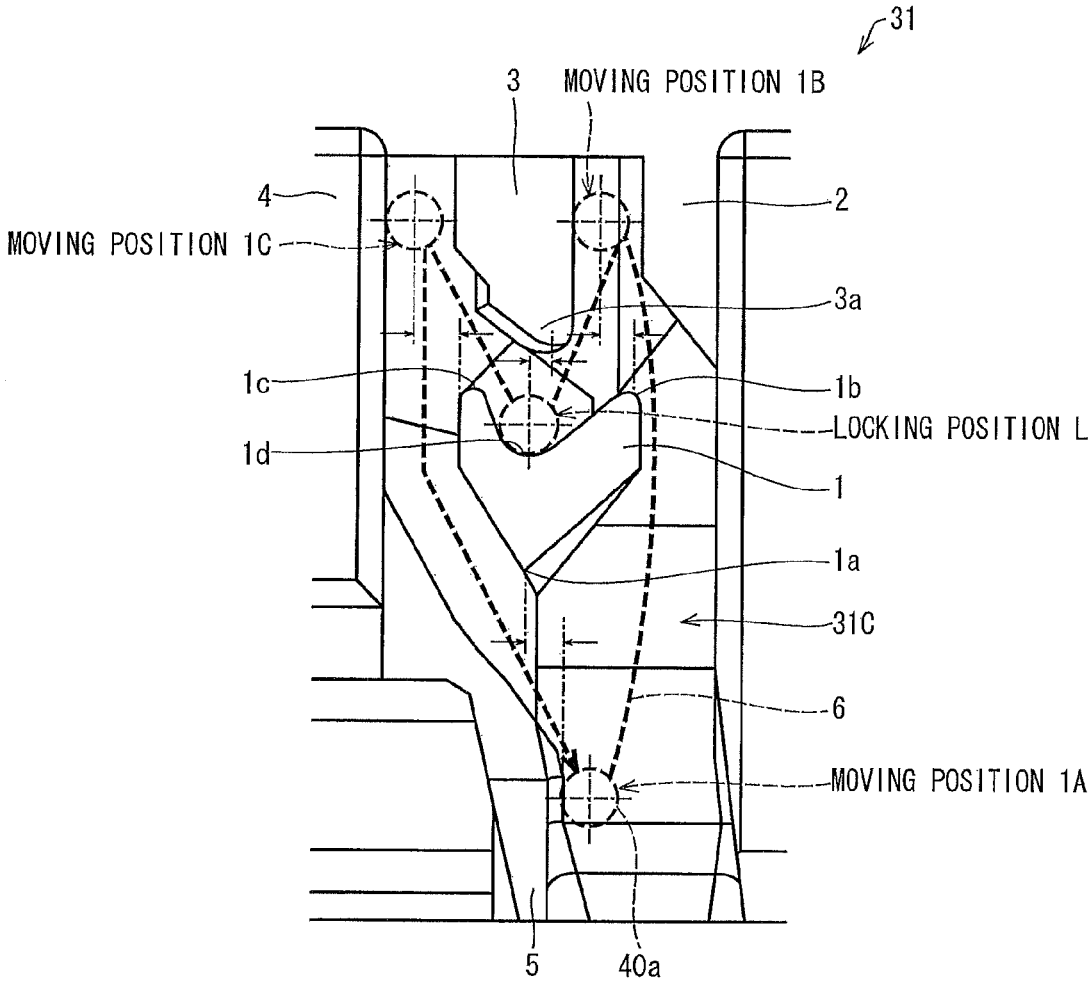
FIG. 9 is a plan view illustrating a configuration of a plunger main body which is a constituent member of a heart cam mechanism of a switch according to one or more embodiments of the claimed invention.

With a heart cam mechanism which is the special feature of the present switch, it is possible to realize a highly reliable switch open/close mechanism that prevents an end part of a lock pin from moving in a reverse direction even in a case where a step-like part of a bottom surface of a cam groove is worn out. FIG. 9 is a plan view illustrating a configuration of a plunger main body 31 which is a constituent member included in the heart cam mechanism of the present switch.

As illustrated in FIG. 9, a cam groove 31C includes a heart cam 1 and surrounding cams 2 through 5 that surround the heart cam 1. The heart cam 1 is heart-shaped and has a concave part 1*d*. The heart cam 1 has (i) a vertex 1*a* (first vertex) on a side opposite the concave part 1*d* and (ii) two vertices 1*b*•1*c* (second and third vertices) on a concave-part-1*d* side. The surrounding cam 3, which faces the concave part 1*d*, has a convex part 3*a* (locking position guiding point).

While the switch is in a locked state (see (a) and (b) of FIG. 7), the upper end part 40*a* of the lock pin 40 is engaged with the concave part 1*d* of the heart cam 1, and is positioned at the locking position L. While the switch is pressed, the upper end part 40*a* slides while pushing against a bottom surface of the cam groove 31C located outside the heart cam 1, and moves along a heart-shaped path 6 which is depressed at the locking position L. Note that a vertex position opposite the locking position L of the heart-shaped path 6 is designated as a moving position 1A (first position). Then, two vertex positions on a locking-position-L side are designated as moving positions 1B•1C (second and third positions). In this case, the upper end part 40*a* passes through the moving position 1A, the moving position 1B, the locking position L, and the moving position 1C in this order. The convex part 3*a* of the surrounding cam 3 serves as a locking position guiding point that guides the upper end part 40*a* from the moving position 1B to the locking position L.

The heart-shaped path 6 is similar in shape to the heart cam 1. That is, the moving positions 1A through 1C of the heart-shaped path 6 correspond to the vertices 1*a* through 1*c* of the heart cam 1, respectively. The locking position L corresponds to the concave part 1*d* of the heart cam 1 (or the convex part 3*a* of the surrounding cam 3).

As illustrated in FIG. 9, at the moving position 1A, the moving position 1B, the locking position L, and the moving position 1D, a center part of the upper end part 40*a* of the lock pin 40 is shifted from the vertex 1*a*, the vertex 1*b*, the convex part 3*a*, and the vertex 1*c*, respectively. While the upper end part 40*a* is located at each one of the moving position 1A, the moving position 1B, and the locking position L, the upper end part 40*a* is shifted (i) from a corresponding one of reference lines of the vertex 1*a*, the vertex 1*b*, the convex part 3*a*, and the vertex 1*c*, respectively and (ii) toward part of the path where the upper end part 40*a* will move from said each one of the positions to a next position, given that the reference lines are respective lines extending in a pressing-operation direction from the vertex 1*a*, the vertex 1*b*, the convex part 3*a*, and the vertex 1*c*. More specifically, the center part of the upper end part 40*a* at the moving position 1A is shifted (i) from the reference line extending in the pressing-operation direction from the vertex 1*a* of the heart cam 1 and (ii) toward part of the path where the upper end part 40*a* will move from the moving position 1A to the moving position 1B. The center part of the upper end part 40*a* at the moving position 1B is shifted (i) from the reference line extending in the pressing-operation direction from the vertex 1*b* of the heart cam 1 and (ii) toward part of the path where the upper end part 40*a* will move from the moving position 1B to the locking position L. The center part of the upper end part 40*a* at the locking position L is shifted (i) from the reference line extending in the pressing-operation direction from the convex part 3*a* of the surrounding cam 3 and (ii) toward part of the path where the upper end part 40*a* will move from the locking position L to the moving position 1C. The center part of the upper end part 40*a* at the moving position 1C is shifted (i) from the reference line extending in the pressing-operation direction from the vertex 1*c* of the heart cam 1 and (ii) toward part of the path where the upper end part 40*a* will move from the moving position 1C to the moving position 1A.

According to the present switch, the heart cam 1 and the surrounding cams 2 through 5 are provided so that the upper end part 40*a* is positioned as described above while located at each of the moving position 1A, the moving position 1B, the locking position L, and the moving position 1C. Therefore, while the upper end part 40*a* moves along the heart-shaped path 6 by passing through the positions, the corresponding vertices 1*a* through 1*c* of the heart cam 1 and the corresponding convex part 3*a* of the surrounding cam 3 serve as moving direction restricting sections for restricting moving directions of the upper end part 40*a* to respective directions in which the upper end part 40*a* should move to next positions. This prevents the upper end part 40*a* from moving in a reverse direction, and therefore causes the upper end part 40*a* to smoothly move from each of the moving position 1A, the moving position 1B, the locking position L, and the moving position 1D to a next one. As a result, with the heart cam mechanism of the present switch, it is possible to prevent the end part of the lock pin from moving in a reverse direction even in a case where the step-like part of the bottom surface of the cam groove is worn out. This allows a highly reliable switch open/close mechanism to be realized.

Figure 10:
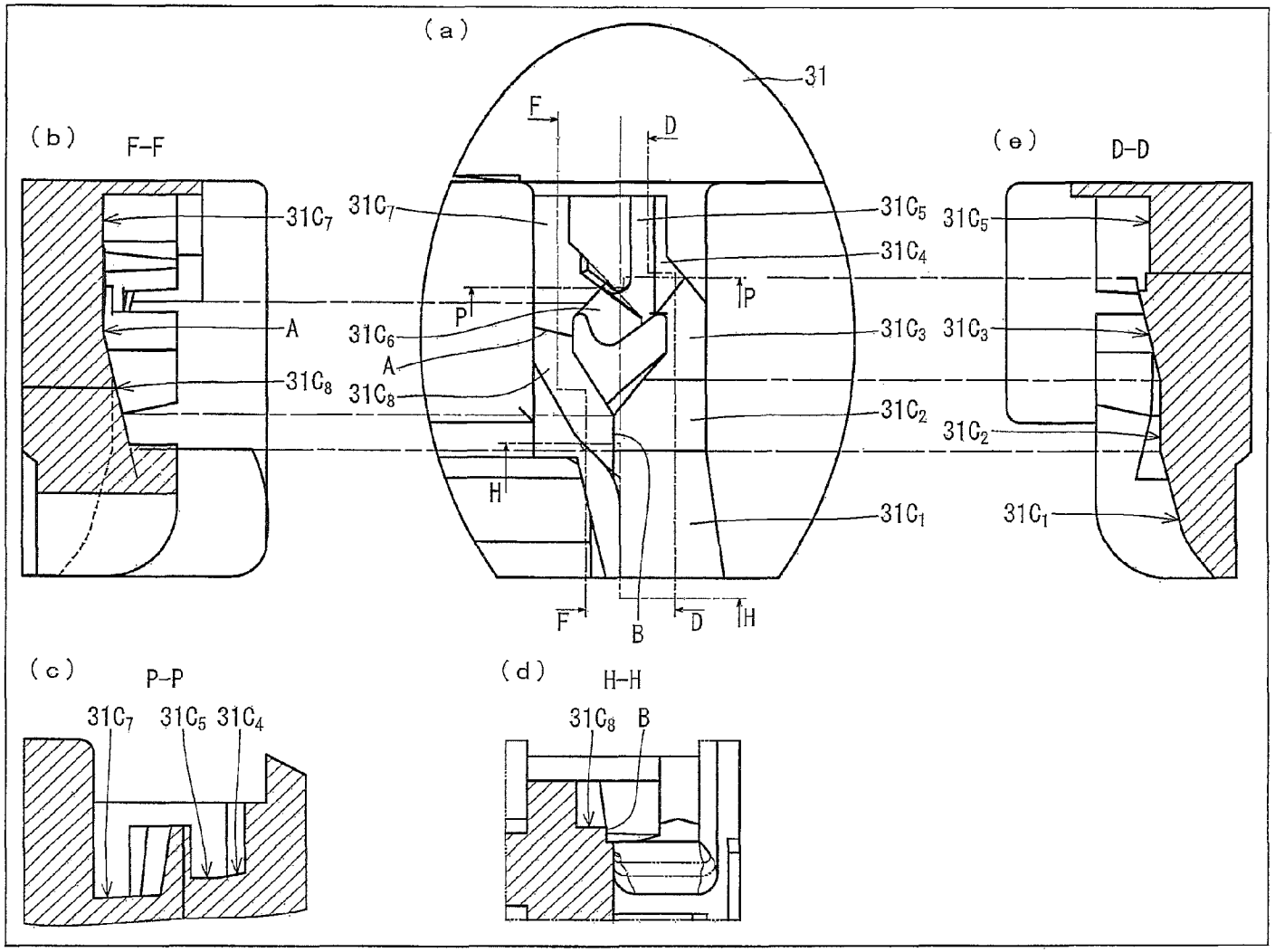
FIG. 10 is a set of views (a) through (e) illustrating a configuration of bottom surfaces of a cam groove; (a) of FIG. 10 being a top view, (b) of 10 being a cross-sectional view taken along the line F-F shown in (a) of FIG. 10, (c) of FIG. 10 being a cross-sectional view taken along the line P-P shown in (a) of FIG. 10, (d) of FIG. 10 being a cross-sectional view taken along the line H-H shown in (a) of FIG. 10, and (e) of FIG. 10 being a cross-sectional view taken along the line D-D shown in (a) of FIG. 10.
Figure 11:
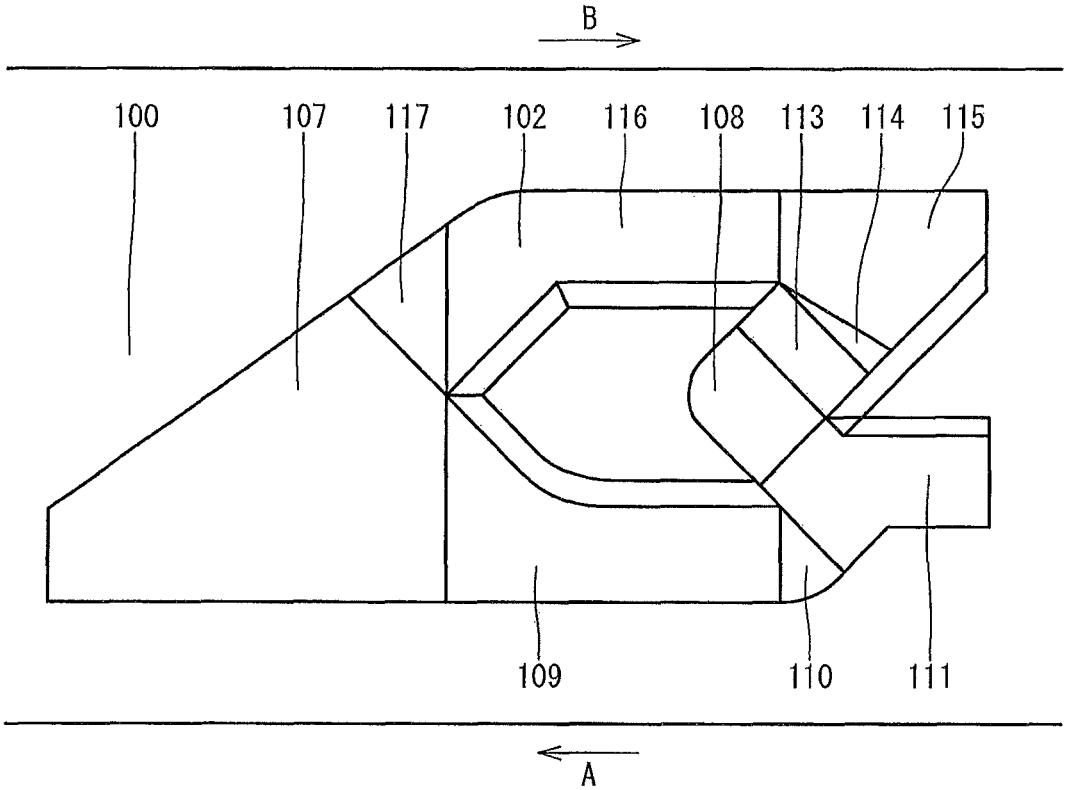
FIG. 11 is a plan view illustrating a cam-groove structure disclosed in Patent Literature 1.

FIG. 10 illustrates a configuration of the bottom surface of the cam groove 31C. (a) of FIG. 10 is a top view. (b) of FIG. 10 is a cross-sectional view taken along the line F-F shown in (a) of FIG. 10. (c) of FIG. 10 is a cross-sectional view taken along the line P-P shown in (a) of FIG. 10. (d) of FIG. 10 is a cross-sectional view taken along the line H-H shown in (a) of FIG. 10. (e) of FIG. 10 is a cross-sectional view taken along the line D-D shown in (a) of FIG. 10.

As illustrated in (a) of FIG. 10, the cam groove 31C includes an initial region 31$C_1$, a region 31$C_2$, a first inclined groove 31$C_3$, a second inclined groove 31$C_4$, a flat groove 31$C_5$, a locking region 31$C_6$, a third inclined groove 31$C_7$, and a fourth inclined groove 31$C_8$. Note that a pathway extending from the moving position 1A to the moving position 1B illustrated in FIG. 9 includes the initial region 31$C_1$, the region 31$C_2$, the first inclined groove 31$C_3$, the second inclined groove 31$C_4$, and the flat groove 31$C_5$. A pathway (first pathway) extending from the moving position 1B to the locking position L includes the flat groove 31$C_5$ and the locking region 31$C_6$. A pathway (second pathway) extending from the locking position L to the moving position 1C includes the locking region 31$C_6$ and the third inclined groove 31$C_7$. A pathway (third pathway) extending from the moving position 1C to the moving position 1A includes the third inclined groove 31$C_7$, the fourth inclined groove 31$C_8$, and the initial region 31$C_1$.

Note that as illustrated in (c) of FIG. 10, respective bottom surfaces of the second inclined groove 31$C_4$ and of the flat groove 31$C_5$ as viewed from the cross section perpendicular to the pressing-operation direction (P-P cross section) are inclined downwards from the moving position 1B toward the moving position 1C in a pushing direction of the upper end part 40*a*. This prevents the upper end part 40*a*, which has left the moving position 1B and reached the locking position L (locking region 31$C_6$), from moving back toward the moving position 1B. Note that the "pushing direction" of the upper end part 40*a* can be described as a direction in which the upper end part 40*a* extends from a bending part of the lock pin 40.

A bottom surface of the third inclined groove 31$C_7$ as viewed from the cross section perpendicular to the pressing-operation direction (P-P cross section) is inclined downwards from the moving position 1B toward the moving position 1C in the pushing direction of the upper end part 40*a*. This prevents the upper end part 40*a*, which has left the locking position L (locking region 31$C_6$) and reached the moving position 1C, from moving back toward the locking position L.

Since the respective bottom surfaces of the second inclined groove 31$C_4$, the flat groove 31$C_5$, and of the third inclined groove 31$C_7$ are thus inclined, it is possible to prevent the upper end part 40*a* of the lock pin 40 from moving in respective reverse directions when moving from the moving position 1B to the locking position L and when moving from the locking position L to the moving position 1C.

As illustrated in (d) of FIG. 10, on the pathway (third pathway) extending from the moving position 1C to the moving position 1A, there is provided a step B between the fourth inclined groove 31$C_8$ and initial region 31$C_1$ (corresponding the moving position 1A illustrated in FIG. 9) such that a bottom surface of the initial region 31$C_1$ drops from the fourth inclined groove 31$C_8$ toward the pushing direction. In addition, as illustrated in (a) of FIG. 10, the step B is provided so as to extend in the pressing-operation direction from the vertex 1*a* of the heart cam 1. This causes the step B to prevent the upper end part 40*a*, which has passed through the step B and reached the initial region 31$C_1$, from moving back toward the fourth inclined groove 31$C_8$. As a result, such an effect is produced that the center part of the upper end part 40*a* located at the moving position 1A is reliably shifted (i) from the vertex 1*a* of the heart cam 1 and (ii) toward a direction where the upper end part 40*a* will move from the moving position 1A to the moving position 1B. Note that, in view of the effect, the step B may be provided closer to the moving position 1A than is the vertex 1*a* of the heart cam 1.

On the pathway (third pathway) extending from the moving position 1C to the moving position 1A, the fourth inclined groove 31$C_8$ has a bottom surface that is inclined upwards from the moving position 1C toward the moving position 1A in a direction opposite the pushing direction. Then, an inclination starting position A of the bottom surface of the fourth inclined groove 31$C_8$ is located closer to the moving position 1A than is the vertex 1*c* of the heart cam 1. This prevents the upper end part 40*a*, which is moving from the moving position 1C to the moving position 1A, from moving to the locking position L. Furthermore, it is possible to sufficiently secure a difference in height between the bottom surface of the fourth inclined groove 31$C_8$ and the bottom surface of the initial region 31$C_1$.

Note that the following Table 1 shows correspondence between (i) the regions of the cam groove provided in the plunger main body 31' illustrated in FIGS. 5 through 8 and (ii) the respective regions of the cam groove provided in the plunger main body 31 illustrated in FIG. 10.

TABLE 1

| | Cam groove of plunger main body 31' (FIGS. 5 through 8) | Cam groove of plunger main body 31 (FIG. 10) |
|---|---|---|
| Initial region | 31$C_1$' | 31$C_1$ |
| Region | | 31$C_2$ |
| First inclined groove | 31$C_2$' | 31$C_3$ |
| Second inclined groove | 31$C_3$' | 31$C_4$ |
| Flat groove | | 31$C_5$ |
| Locking region | | 31$C_6$ |
| Third inclined groove | 31$C_4$' | 31$C_7$ |
| Fourth inclined groove | 31$C_5$' | 31$C_8$ |
| Fifth inclined groove | 31$C_6$' | |
| Sixth inclined groove | 31$C_7$' | |

The claimed invention is not limited to the description of the embodiments, but can be altered in many ways by a person skilled in the art within the scope of the claims. An embodiment derived from a proper combination of technical means disclosed in different embodiments is also encompassed in the technical scope of the claimed invention.

According to one or more embodiments of the claimed invention, a heart cam mechanism includes: a cam groove including a heart cam and surrounding cams; and a lock pin (i) having one end part which is fixed and (ii) the other end part which is a sliding end part that slides while pushing against a bottom surface of the cam groove, the heart cam having a concave part for engaging with the sliding end part and releasing the engaging so as to switch between a locked state and an unlocked state of a switch whose contact point is opened or closed by a pressing operation, the sliding end part being configured to engage with the concave part at a locking position, the sliding end part being configured to simultaneously (i) make reciprocating motion in a pressing-operation direction in which the pressing operation is carried out and (ii) move, in the cam groove located outside the heart cam, along a heart-shaped path which is depressed at the locking position, the heart-shaped path having a first position which is a vertex position opposite the locking position and having a second position and a third position which are two vertex positions on a locking-position side, the sliding end part being configured to pass through the first position, the second position, the locking position, and the third position in this order, the heart cam having a first vertex, a second vertex, and a third vertex corresponding to the first position, the second position, and the third position of the heart-shaped path, respectively, a surrounding cam, which faces the concave part, having a locking position guiding point for guiding the sliding end part from the second position to the locking position, and the heart cam and the surrounding cams being provided such that, while the sliding end part is located at each one of the first position, the second position, the locking position, and the third position, a center part of the sliding end part is shifted from a corresponding one of reference lines toward part of the heart-shaped path where the sliding end part will move from said each one of the positions to a next position, the reference lines being respective lines extending in the pressing-operation direction from the first vertex, the second vertex, the locking position guiding point, and the third vertex.

According to the configuration, the heart cam and the surrounding cams being provided such that, while the sliding part is located at each one of the first position, the second position, the locking position, and the third position, a center part of the sliding end part is shifted from a corresponding one of reference lines toward part of the heart-shaped path where the sliding end part will move from said each one of the positions to a next position, the reference lines being respective lines extending in the pressing-operation direction from the first vertex, the second vertex, the locking position guiding point, and the third vertex. More specifically, the members are arranged in relation to each other as follows:

The center part of the sliding end part at the first position is shifted (i) from the reference line extending in the pressing-operation direction from the first vertex of the heart cam and (ii) toward part of the path where the sliding end part will move from the first position to the second position. The center part of the sliding end part at the second position is shifted (i) from the reference line extending in the pressing-operation direction from the second vertex of the heart cam and (ii) toward part of the path where the sliding end part will move from the second position to the locking position. The center part of the sliding end part at the locking position is shifted (i) from the reference line extending in the pressing-operation direction from the locking position guiding point of the surrounding cam and (ii) toward part of the path where the sliding end part will move from the locking position to the third position. The sliding end part at the third position is shifted (i) from the reference line extending in the pressing-operation direction from the first vertex of the heart cam and (ii) toward part of the path where the sliding end part will move from the third position to the first position.

According to the configuration, the heart cam and the surrounding cams are provided so that the sliding end part is positioned as described above while located at each of the first position, the second position, the locking position, and the third position. Therefore, according to the configuration, while the sliding end part moves along the heart-shaped path by passing through the positions, the corresponding first through third vertices of the heart cam and the corresponding locking position guiding point of the surrounding cam serve as moving direction restricting sections for restricting moving directions of the sliding end part to respective directions in which the sliding end part should move to next positions. This prevents the sliding end part from moving in a reverse direction, and therefore causes the sliding end part to smoothly move from each of the first position, the second position, the locking position, and the third position to a next one. As a result, with the configuration, it is possible to prevent the end part of the lock pin from moving in a reverse direction even in a case where the step-like part of the bottom surface of the cam groove is worn out. This makes it possible to provide a heart cam mechanism that allows a highly reliable switch open/close mechanism to be realized.

The heart cam mechanism according to one or more embodiments of the claimed invention is configured such that, while a pathway extending from the second position to the locking position serves as a first pathway and a pathway extending from the locking position to the third position serves as a second pathway, respective bottom surfaces of the first pathway and of the second pathway as viewed from a cross section perpendicular to the pressing-operation direction are inclined downwards from the second position to the third position in a pushing direction of the sliding end part.

According to the configuration, the respective bottom surfaces of the first pathway and of the second pathway as viewed from a cross section perpendicular to the pressing-operation direction are inclined downwards from the second position to the third position in a pushing direction of the sliding end part. This prevents the sliding end part from moving in respective reverse directions when moving from the second position to the locking position and when moving from the locking position to the third position.

The heart cam mechanism according to one or more embodiments of the claimed invention is configured such that: a third pathway extending from the third position to the first position has a step provided such that a bottom surface of a part of the cam groove, which part corresponds to the first position, drops toward the pushing direction of the sliding end part; and the step is provide so as to (i) extend in the pressing-operation direction from the first vertex of the heart cam or (ii) be located closer to the first position than is the first vertex.

The step is thus provided so as to (i) extend in the pressing-operation direction from the first vertex of the heart cam or (ii) be located closer to the first position than is the first vertex. This causes the step to prevent the sliding end part, which has passed through the step and reached the first position, from moving back toward the third position. Therefore, the center part of the sliding end part located at the first position is reliably shifted (i) from the first vertex of the heart cam and (ii) toward a direction where the sliding end part will move from the first position to the second position.

The heart cam mechanism according to one or more embodiments of the claimed invention is configured such that: the third pathway is provided with an inclined groove having a bottom surface inclined upwards from the third position to the first position in a direction opposite the pushing direction of the sliding end part; and the inclined groove has an inclination starting position which is located closer to the first position than is the third vertex of the heart cam.

According to the configuration, the third pathway is provided with an inclined groove having a bottom surface inclined upwards from the third position to the first position in a direction opposite the pushing direction of the sliding end part, and the inclined groove has an inclination starting position which is located closer to the first position than is the third vertex of the heart cam. This prevents the sliding end part, which is moving from the third position to the first position, from moving back to the locking position. Furthermore, it is possible to sufficiently secure a difference in height between (i) the bottom surface of the inclined groove and (ii) the bottom surface of part of the cam groove which part corresponds to the first position.

According to one or more embodiments of the claimed invention, a switch includes: a pressing part by which the pressing operation is carried out to open or close a circuit; the above-described heart cam mechanism; and a base that fixes the one end part of the lock pin.

With the configuration, it is possible to prevent the end part of the lock pin from moving in a reverse direction even in a case where the step-like part of the bottom surface of the cam groove is worn out. This makes it possible to provide a switch that allows a highly reliable switch open/close mechanism to be realized.

INDUSTRIAL APPLICABILITY

One or more embodiments of the claimed invention can be used for electric appliances, such as washing machines and dish washers, which are capable of turning off a power switch in response to an external signal.

REFERENCE NUMERALS LIST

1 Heart cam
1*a* Vertex (first vertex)
1*b* Vertex (second vertex)
1*c* Vertex (third vertex)
1*d* Concave part
1A Moving position (first position)
1B Moving position (second position)
1C Moving position (third position)
L Locking position
2 Surrounding cam
3 Surrounding cam
3*a* Convex part (locking position guiding point)
4 Surrounding cam
5 Surrounding cam
6 Heart-shaped path
10 Base
11 Wall
12 Wall
13 Dividing wall
14 Engaging groove
20 Contact point mechanism
30, 30' Plunger section
31, 31' Plunger main body (pressing part)
31A Operation part
31B Shank parts
31C, 31C' Cam groove
31D Pressing convex part
32 Coil springs
32*a* End part
32*b* End part
40 Lock pin
40*a* Upper end part (sliding end part)
40*b* Lower end part
50 Housing

The invention claimed is:

1. A heart cam mechanism comprising:

a cam groove including a heart earn and surrounding cams; and a lock pin (i) having one end part that is fixed; and (ii) another end part that is a sliding end part that slides while pushing against a bottom surface of the cam groove, the heart cam having a concave part for engaging with the sliding end part and releasing the engaging so as to switch between a locked state and an unlocked state of a switch whose contact point is opened or closed by a pressing operation, the sliding end part being configured to engage with the concave part at a locking position, the sliding end part being configured to simultaneously (i) make reciprocating motion in a pressing-operation direction in which the pressing operation is carried out; and (ii) move, in the cam groove located outside the heart cam, along a heart-shaped path which is depressed at the locking position, the heart-shaped path having a first position, which is a vertex position opposite the locking position, and having a second position and a third position, which are two vertex positions on a locking-position side, the sliding end part being configured to pass through the first position, the second position, the locking position, and the third position in this order, the heart earn having a first vertex, a second vertex, and a third vertex corresponding to the first position, the second position, and the third position of the heart-shaped path, respectively, a surrounding cam of the surrounding cams, which faces the concave part, having a locking position guiding point for guiding the sliding end part from the second position to the locking position, and the heart cam and the surrounding cams being provided such that, while the sliding end part is located at each one of the first position, the second position, the locking position, and the third position, a center part of the sliding end part is shifted from a corresponding one of reference lines toward part of the heart-shaped path where the sliding end part will move from said each one of the positions to a next position, the reference lines being respective lines extending in the pressing-operation direction from the first vertex, the second vertex, the locking position guiding point, and the third vertex, wherein, while a pathway extending from the second position to the locking position serves as a first pathway and a pathway extending from the locking position to the third position serves as a second pathway, respective bottom surfaces of the first pathway and of the second pathway as viewed from a cross section perpendicular to the pressing-operation direction are inclined downwards from the second position to the third position in a pushing direction of the sliding end part.

2. A switch comprising:

a pressing part by which the pressing operation is carried out to open or close a circuit;

the heart cam mechanism recited in claim 1; and a base that fixes the one end part of the lock pin.

3. The heart cam mechanism as set forth in claim 1, wherein a third pathway extending from the third position to the first position has a step provided such that a bottom surface of a part of the cam groove, which part corresponds to the first position, drops toward a pushing direction of the sliding end part, and wherein the step is provided so as to (i) extend in the pressing-operation direction from the first vertex of the heart cam; or (ii) be located closer to the first position than is the first vertex.

4. The heart cam mechanism as set forth in claim 3, wherein the third pathway is provided with an inclined groove having a bottom surface inclined upwards from the third position to the first position in a direction opposite the pushing, direction of the sliding end part, and wherein the inclined groove has an inclination starting position, which is located closer to the first position than is the third vertex of the heart cam.

* * * * *